United States Patent [19]

Kirihara et al.

[11] 4,385,940

[45] May 31, 1983

[54] METHOD FOR ANTICORROSIVE TREATMENT OF GALVANIZED STEEL

[75] Inventors: Shigeki Kirihara, Kobe; Tsutomu Ohshima, Kakogawa, both of Japan

[73] Assignee: Kobe Steel, Limited, Kobe, Japan

[21] Appl. No.: 224,480

[22] Filed: Jan. 12, 1981

[30] Foreign Application Priority Data

Jan. 11, 1980 [JP] Japan ..... 55-1765

[51] Int. Cl.[3] ..... C23F 7/08

[52] U.S. Cl. ..... 148/6.15 R; 148/6.14 R; 148/6.14 A

[58] Field of Search ..... 148/6.14 A, 6.15 R, 148/6.14 R

[56] References Cited

U.S. PATENT DOCUMENTS

| | | | |
|---|---|---|---|
| 1,798,218 | 3/1931 | Pacz | 148/6.14 A |
| 2,219,977 | 10/1940 | Brill | 148/6.14 R |
| 2,805,969 | 9/1957 | Goodspeed | 148/6.14 A |
| 3,404,044 | 10/1968 | Russell | 148/6.2 |
| 3,528,860 | 9/1970 | Kronstein | 148/6.15 R |
| 3,586,543 | 6/1971 | Iijima | 148/6.15 R |
| 4,233,088 | 11/1980 | Kronstein | 148/6.16 |

*Primary Examiner*—Ralph S. Kendall

*Attorney, Agent, or Firm*—Oblon, Fisher, Spivak, McClelland & Maier

[57] ABSTRACT

An anticorrosive treatment for preventing white rust on galvanized steels, comprises applying to the surface of a galvanized steel sheet an acidic solution containing molybdic acid or a molybdate in a concentration of 10–200 g/l calculated as molybdenum and adjusted to a pH value of 1–6 by addition of an organic or inorganic acid.

7 Claims, 2 Drawing Figures

METHOD FOR ANTICORROSIVE TREATMENT OF GALVANIZED STEEL

BACKGROUND OF THE INVENTION

This invention relates to an anticorrosive treatment for galvanized or zinc-coated steels, and more particularly to a method of anticorrosive treatment which protects zinc coatings on the surfaces of steel materials against white rust.

It is the general practice in the art to provide a zinc coating on the surface of steel by galvanization or other means for protection against rust or corrosion. However, the surface of the zinc coating is susceptible to white rust when exposed to the atmosphere due to reactions with moisture or carbon dioxide in the atmosphere.

In order to prevent the formation of white rust, the zinc-coated steel may be further treated with a chromate. Although the chromate treatment has the advantages of excellent anticorrosive properties, simplicity and low cost, the use of chromate is restricted by environmental polution regulations and causes problems such as toxicity to workers of chromate spattered during the treating process, difficult disposal of the chrome sludge after the treatment of the spent liquor, possible chrome exudation on products after the treatment with chromate, inferior adhesion of paint, and the like.

In another process, a treatment with a phosphate is employed to improve the corrosion resistance of galvanized steel and paint adhesion thereto, but it is far inferior to the chromate treatment in imparting corrosion resistance.

For these reasons, various techniques have recently been proposed and applied for preventing formation of white rust on zinc-coated steel materials using a pollution-free substance instead of chromate, for example, using inorganic compounds, organic compounds, organic macromolecular compounds (mainly resins) or combinations thereof, or using immersion, coating or electrolysis. The following are some examples of these methods.

In Japanese Patent Publication No. 6846/71, there is described a method for forming an anticorrosive coating by immersing a zinc-coated steel in a treating solution consisting mainly of an aqueous solution of molybdate of a concentration less than 0.5 M and an aqueous solution of 0.05–45 wt. % of a water-soluble organic compound or an organic macromolecular compound, followed by drying by heating.

Japanese Patent Publication No. 2419/76 discloses a method for forming an anticorrosive coating by immersing a zinc-coated steel in an aqueous solution 1/40–1/50 M in magnesium molybdate or calcium molybdate.

Further, Japanese Laid-open Patent Specification No. 14141/76 discloses a method for forming an anticorrosive coating by immersing a zinc-coated steel in an aqueous solution of ammonium molybdate containing ammonium sulfate.

The methods of the above-mentioned publications are more or less effective for preventing the production of white rust on the zinc coated steel materials but require a complicated process for the preparation of the treating liquid or a long processing time.

Hence a need has continued to exist for a method of protecting galvanized steel from white rust which is simple and free from the pollution problems associated with chromate solutions.

SUMMARY OF THE INVENTION

With the foregoing in view, the present invention has as its object to provide an anticorrosion treatment for zinc-coated steel, which overcomes the above-mentioned problems and drawbacks of the conventional methods. A more particular object of the invention is to provide an anticorrosion treatment for zinc-coated steel, which effectively prevents formation of white rust.

According to the present invention, there is provided an anticorrosion treatment to prevent white rust on zinc-coated materials, comprising: contacting the zinc-coated material with an acidic treating solution containing at least molybdic acid or a molybdate in an amount of 10–100 g/l calculated as molybdenum and adjusted to a pH of 1–6 by addition of an organic or inorganic acid. The treating solution may be applied to zinc-coated material such as galvanized steel by dipping, spraying, roll-coating, or the like.

The above and other objects, features and advantages of the invention will become apparent from the following particular description of the invention and the appended claims, taken in conjunction with the accompanying drawing.

DETAILED DESCRIPTION OF THE INVENTION AND PREFERRED EMBODIMENTS

Figure 1:
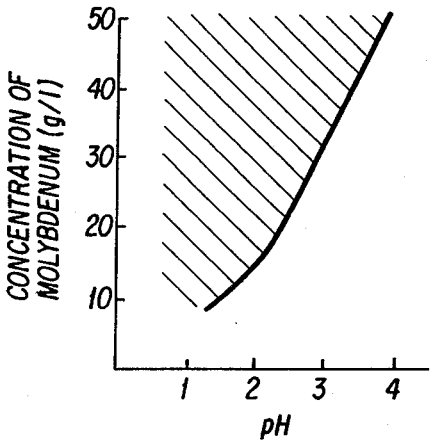
FIG. 1 is a graphic illustration of the relation between the concentration of molybdenum and pH of a solution containing potassium molybdate and the corrosion resistance produced by this solution when used in the process of this invention.

The anti-corrosion treatment according to the present invention employs at least molybdic acid or a molybdate selected from the group consisting of sodium molybdate, potassium molybdate and lithium molybdate which are satisfactory in solubility and anticorrosive properties. From the standpoint of anticorrosive effect and economical use, the concentration of molybdic acid and/or molybdate is suitably in the range of 10–200 g/l calculated as molybdenum and preferably in the range of 10–100 g/l.

In the anticorrosive treatment according to the present invention, the treating liquid is acidified by addition of an acid which is selected from inorganic acids such as phosphoric acid, nitric acid, sulfuric acid, and hydrochloric acid; or organic acids such as oxalic acid, acetic acid, citric acid, malonic acid, succinic acid, tartaric acid, and lactic acid. Among these acids, phosphoric acid is especially superior with respect to the appearance of the treated material after the chemical treatment, the stability of the treating bath and the anticorrosive properties of the coating film. This is because, in an acidic bath containing phosphoric acid, molybdate forms a stable solution as a heteropoly-complex of phosphomolybdate by reaction with phosphoric acid. The better anticorrosive effect of phosphoric acid is considered to be attributable to the synergistic effects of an anticorrosive phosphate film formed on the surface of the zinc coating of the steel material and an anticorrosive passive film which is formed in the acidic bath by molybdenum in a manner similar to chromium.

As mentioned hereinbefore, the anticorrosion treatment of zinc-coated steel materials according to the present invention employs a treating bath which is acidified by the addition of molybdic acid and/or a molybdate or molybdates. In this connection, it is to be noted that the resulting anticorrosive property is dictated by the concentration of molybdic acid and/or molybdate (10–200 g/l calculated as molybdenum) relative to the pH of the treating bath. More particularly, with a high concentration of molybdic acid and/or molybdate, it is possible to form a satisfactory anticorrosive coating film in a relatively high pH treating bath. However, when the concentration of molybdic acid and/or molybdate is low, the pH of the treating bath has to be lowered. Nevertheless, where the concentration of molybdic acid and/or molybdate is in the range of 10–200 g/l calculated as molybdenum, it is difficult to form an anticorrosive film at a pH below 1. On the other hand, the anticorrosive property becomes deficient when the solution has a pH greater than 6. Needless to say, the anticorrosive property is considerably deteriorated when the solution is in the alkaline or neutral range. Consequently, the pH of the treating bath is suitably kept in the range of 1–6, preferably in the range of 1–4.

Further, in the anticorrosion treatment according to the present invention, it suffices to maintain the treating bath at room temperature, about 20° C. Higher bath temperatures are advantageous for the chemical reactions and the subsequent drying, but increase the vaporization of the acid. Therefore, the bath temperature preferably does not exceed about 80° C. maximum. Since cooling the treating bath below room temperature has no effect on the formation of the anticorrosive film, the treating bath is normally maintained at a temperature of 20° C. to 80° C. In industrial applications, it is preferably maintained in a temperature range of about 20° C.–80° C.

The duration of the treatment of zinc-coated steel at the above-mentioned bath temperature should be at least longer than 1 second in order to ensure stabilized formation of the anticorrosive film but need not be excessively prolonged, since an excessive treatment time does not form proportionately more of the anticorrosive film. A treating time of 2–3 seconds suffices to ensure formation of an industrially satisfactory anticorrosive film.

Having generally described the invention, a more complete understanding can be obtained by reference to certain specific examples, which are provided herein for purposes of illustration only and are not intended to be limiting unless otherwise specified.

EXAMPLE 1

Treating Conditions (1) Treating bath

An aqueous solution was prepared, containing potassium molybdate in a concentration of 53 g/l calculated as molybdenum.

(2) Acids used for pH adjustment

Phosphoric acid, sulfuric acid and acetic acid.

(3) Method of application

An electrogalvanized steel plate having a zinc coating of 20 g/m$^2$ was dipped in the treating bath at 20° C. for 2–3 seconds and excess liquid was removed by nip rolls, followed by drying for about 30 seconds at about 130° C.

(4) Rating of corrosion resistance

The corrosion resistance was rated according to the criteria of Table 1, after an anticorrosion test as prescribed in JIS-Z-2371, wherein the white rust formation 24 hours after a brine spray test is measured.

(5) Results of the anticorrosion test are tabulated in Table 2.

As shown in Table 2, at the same pH, the treating solution using phosphoric acid excels the others (acetic acid and sulfuric acid) in conferring corrosion resistance. Since there is no difference in corrosion resistance between organic and inorganic acids other than phosphoric acid, it is evident that the corrosion resistance is influenced by the pH. When an acid other than phosphoric acid is used, the corrosion resistance is considerably deteriorated in at a relatively high pH (about pH 6), although it is still appreciably higher than that of an untreated material which exhibits white rust on its entire surface (100%) within one hour after the brine spray test.

TABLE 1

| WHITE RUST FORMATION | CORROSION RESISTANCE RATING |
|---|---|
| 0–1% | 5 |
| 2–5% | 4 |
| 6–10% | 3 |
| 11–50% | 2 |
| 51–100% | 1 |

TABLE 2

| $K_2MoO_4$ + Acid pH | Phosphoric Acid | Sulfuric Acid | Acetic Acid |
|---|---|---|---|
| 6 | 2 | 1 (white rust:60%) | 1 (white rust:60%) |
| 5 | 3 | 2 | 2 |
| 4 | 4 | 3 | 3 |
| 3 | 5 | 3 | 3 |

EXAMPLE 2

Galvanized steel plates were treated under the same conditions as in Example 1.

In this example, the concentration and acidity (pH) of the potassium molybdate solution was varied in the respective tests.

The results of the anticorrosion tests are shown in Table 3 below. The comparative examples show the results for an untreated galvanized steel plate, a plate treated with phosphoric acid alone, and plates treated with potassium molybdate in alkaline and neutral ranges.

TABLE 3

| Treatment | | Treating Conditions: Molybdenum concentration (g/l) | pH adjustment | pH | Rating of anticorrosive resistance |
|---|---|---|---|---|---|
| Invention | Acidic solution of $K_2MoO_4$ | 53 | Phosphoric acid | 5 | 3 |
| | Acidic | 53 | Phospho- | 3 | 5 |

TABLE 3-continued

| | Treatment | Treating Conditions: Molybdenum concentration (g/l) | pH adjustment | pH | Rating of anticorrosive resistance |
|---|---|---|---|---|---|
| | solution of $K_2MoO_4$ | | ric acid | | |
| | Acidic solution of $K_2MoO_4$ | 53 | Phosphoric acid | 2 | 5 |
| | Acidic solution of $K_2MoO_4$ | 43 | Phosphoric acid | 5 | 3 |
| | Acidic solution of $K_2MoO_4$ | 43 | Phosphoric acid | 3 | 4 |
| | Acidic solution of $K_2MoO_4$ | 43 | Phosphoric acid | 2 | 5 |
| | Acidic solution of $K_2MoO_4$ | 21 | Phosphoric aicd | 5 | 2 |
| | Acidic solution of $K_2MoO_4$ | 21 | Phosphoric acid | 5 | 3 |
| | Acidic solution of $K_2MoO_4$ | 21 | Phosphoric acid | 2 | 5 |
| Comparative Example | Untreated | — | — | — | 1 |
| | Inorganic acid alone | — | Phosphoric acid | 4 | 1 |
| | Inorganic acid alone | — | Phosphoric acid | 1 | 1 |
| | Alkaline solution of $K_2MoO_4$ | 53 | Potassium hydroxide | 10 | 1 |
| | Neutral solution of $K_2MoO_4$ | 53 | — | 7 | 1 |

TABLE 4

| | Treatment | Treating conditions: Concentration of molybdenum (g/l) | pH adjustment | pH | Rating of anticorrosive resistance |
|---|---|---|---|---|---|
| Invention | Acidic solution of sodium molybdate | 53 | Phosphoric aicd | 5 | 3 |
| | Acidic solution of sodium molybdate | 53 | Phosphoric acid | 3 | 4 |
| | Acidic solution of sodium molybdate | 53 | Phosphoric acid | 1.5 | 5 |
| | Acidic solution of sodium molybdate | 43 | Phosphoric aicd | 5 | 2 |
| | Acidic solution of sodium molybdate | 43 | Phosphoric acid | 3 | 4 |
| | Acidic solution of sodium molybdate | 43 | Phosphoric acid | 1.5 | 5 |
| | Acidic solution of sodium molybdate | 21 | Phosphoric acid | 5 | 2 |
| | Acidic solution of sodium molybdate | 21 | Phosphoric acid | 3 | 3 |

TABLE 4-continued

| | Treatment | Treating conditions: Concentration of molybdenum (g/l) | pH adjustment | pH | Rating of anticorrosive resistance |
|---|---|---|---|---|---|
| | Acidic solution of sodium molybdate | 21 | Phosphoric acid | 1.5 | 4 |
| Comparative Example | Alkaline solution of sodium molybdate | 53 | Sodium hydroxide | 10 | 1 |
| | Neutral solution of sodium molybdate | 53 | — | 7 | 1 |

As is clear from the foregoing table, satisfactory anticorrosion resistance is obtained only with the combinations according to the present invention.

EXAMPLE 3

Galvanized steel plates were treated under the same conditions as in Example 1.

In this example, a solution of sodium molybdate was used in different concentrations, while the concentration of phosphoric acid (pH) was also varied.

The results of the anticorrosion tests are shown in Table 4 below. Comparative examples show the results of treatments with sodium molybdate in alkaline and neutral ranges.

As is clear from Table 4, sodium molybdate also gives good results in the acidic range.

As shown by the foregoing examples, a galvanized steel plate can be given excellent corrosion resistance by treatment with an acidic solution of a molybdate.

Figure 2:
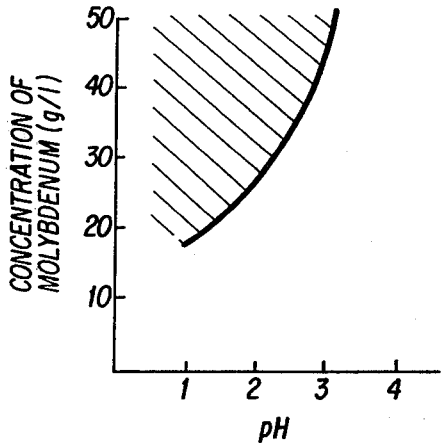
FIG. 2 is a graphic illustration of the relation between the concentration of molybdenum and pH of a solution containing sodium molybdate and the corrosion resistance produced by this solution when used in the process of this invention.

FIGS. 1 and 2 show the influences of the molybdenum concentration and the pH on the corrosion resistance resulting from treatments with potassium molybdate and sodium molybdate, respectively. The hatched areas in FIGS. 1 and 2 indicate the range of corrosion resistance rating of 4 or greater.

It will be seen from FIGS. 1 and 2 that the range of high corrosion resistance of sodium molybdate is shifted toward a high molybdenum concentration and a lower pH value as compared with that of potassium molybdate. Under the same conditions, the anticorrosive property of galvanized steel treated with sodium molybdate is slightly inferior to that treated with potassium molybdate. This is considered to be attributable to the moisture absorption of the coated film of sodium molybdate.

Among alkali metal salts of molybdic acid, lithium molybdate excels the other in moisture absorption but has inferior film-forming properties. Therefore, a coating of high corrosion resistance can be obtained by using lithium molybdate in a mixture with a molybdate which has an excellent film-forming property.

It will be appreciated from the foregoing description that, according to the method of anticorrosive treatment of the present invention, a film with a satisfactory corrosion resistance can be formed on the surfaces of galvanized steel without the problems of toxicity or environmental pollution encountered in the processes using a chromate.

Having now fully described the invention, it will be apparent to one of ordinary skill in the art that many changes and modifications can be made thereto without departing from the spirit or scope of the invention as set forth herein.

What is claimed is:

1. An anticorrosive treatment for preventing white rust on zinc-coated materials comprising contacting said zinc-coated material with an acidic aqueous solution consisting essentially of at least one molybdenum compound selected from the group consisting of molybdic acid and molybdates in a concentration of 10–200 g/l, calculated as molybdenum, and phosphoric acid to adjust the pH to a value of 1–6.

2. A method as set forth in claim 1, wherein the pH of said solution is 1–4.

3. A method as set forth in claim 1, wherein said acidic solution contains at least molybdic acid and/or a molybdate in a concentration of 10–100 g/l calculated as molybdenum.

4. A method as set forth in claim 1, wherein said molybdate is selected from the group consisting of sodium molybdate, potassium molybdate, and lithium molybdate.

5. A method as set forth in claim 1, wherein said solution contains molybdic acid and lithium molybdate.

6. A method as set forth in claim 1, wherein said galvanized steel material is contacted with said solution for a time period longer than 1 second.

7. A method as set forth in claim 1, wherein said solution is maintained at a temperature of 20° C. to 80° C.

* * * * *

UNITED STATES PATENT AND TRADEMARK OFFICE

CERTIFICATE OF CORRECTION

PATENT NO. : 4,385,940

DATED : May 31, 1983

INVENTOR(S) : Shigeki Kirihara and Tsutomu Ohshima

It is certified that error appears in the above-identified patent and that said Letters Patent is hereby corrected as shown below:

In column 3, line 43, "80°C" should read --30°C--;

In Table 2, in the heading of the first column, "$K_2MoO_4$ + Acid" should read --$K_2MoO_4$ + Acid/--;

In column 8, line 5, delete "claim 1" and insert --anyone of claims 1-3--;

In column 8, line 9, delete "claim 1" and insert --anyone of claims 1-4--;

In column 8, line 11, delete "claim 1" and insert --anyone of claims 1-4--;

In column 8, line 14, delete "claim 1" and insert --anyone of claims 1-4--.

Signed and Sealed this

*Fifteenth* Day of *May 1984*

[SEAL]

*Attest:*

*Attesting Officer*

GERALD J. MOSSINGHOFF

*Commissioner of Patents and Trademarks*